US006766669B1

(12) United States Patent
Tung

(10) Patent No.: US 6,766,669 B1
(45) Date of Patent: Jul. 27, 2004

(54) WARP KNITTED FABRIC FOR ZIPPER MOUNTED THEREON

(75) Inventor: Hung Jui Tung, Chang-Hwa Shien (TW)

(73) Assignee: Charm Young Industry Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 10/697,019

(22) Filed: Oct. 31, 2003

(51) Int. Cl.[7] ..... D04B 21/00
(52) U.S. Cl. ..... 66/195
(58) Field of Search ..... 66/195, 196, 169 R, 66/170, 172 R, 169 A, 202; 24/392, 393

(56) References Cited

U.S. PATENT DOCUMENTS 4,228,566 A * 10/1980 Matsuda ..... 66/195
4,378,683 A * 4/1983 Matsuda et al. ..... 66/193
5,615,563 A * 4/1997 Matsuda et al. ..... 66/193
6,076,377 A * 6/2000 Ta-An ..... 66/195
6,370,925 B1 * 4/2002 Akashi et al. ..... 66/195
6,564,590 B2 * 5/2003 Matsuda ..... 66/193

* cited by examiner

*Primary Examiner*—Danny Worrell
(74) *Attorney, Agent, or Firm*—Dennison, Schultz, Dougherty & MacDonald

(57) ABSTRACT

A warp knitted fabric for a zip mounted thereon has a base fabric having first threads, second threads and third threads, wherein the first threads are extended along a warp-wise orientation of the base fabric to form wales and are lapped to form crochets and the second and the third threads are extended along the warp-wise orientation of the base fabric and are repeatedly and cross lapped over two of the wales. The base fabric has a rare portion, which is a region of the base fabric having less of the third threads than the other region thereof. The base fabric further has fourth threads, which is made of a material with a well elasticity, to form an elastic portion. The elastic portion has a side overlapped with a portion of the base fabric on which the third threads are knitted to form an overlapped portion.

8 Claims, 6 Drawing Sheets

WARP KNITTED FABRIC FOR ZIPPER MOUNTED THEREON

BACKGROUND OF THE INVENTION

1. Field of the Invention

The present invention relates generally to a fabric for a zipper mounted thereon and, more particularly to a warp knitted fabric that has a specific portion capable of extension along a transverse direction.

2. Description of the Related Art

A conventional zipper is stitched on two fabrics and the fabrics are stitched on clothing, bag or the like. Conventional fabrics, which are made of chemical fibers, have a weak flexibility such that the fabrics have a weak capacity to sustain the transverse extension force, which is the force exerted on the fabrics along an orientation substantially perpendicular to the elongated orientation, while the zipper has been zipped. The fabrics might be torn or the zipper might be broken while such transverse force is exerted.

There are several solutions for the aforesaid problem, such as the fabric is provided with an enhancement region, which is made of strengthened fabrics, to increase the capacity of the fabric sustaining the transverse extension force. Such fabric is thicker and harder. The second way is to provide a fabric made of woofs. The woofs are made of chemical fabric having a little flexibility. Such fabric has drawbacks of not enough flexibility and fatigue of the chemical fabric after a long time of extension. The third way is to stitch a buffer region on the fabric which the buffer region is made of flexible fabric. The buffer region absorbs a part of the transverse extension force but it is harder for fabrication and the cost of fabrication is higher.

SUMMARY OF THE INVENTION

The primary object of the present invention is to provide a warp knitted fabric for a zipper mounted thereon, which is softer and has comfortable feeling.

The secondary object of the present invention is to provide a warp knitted fabric for a zipper mounted thereon, which has a well flexibility along the transverse orientation.

To achieve these objects of the present invention, a warp knitted fabric comprises a base fabric having first threads, second threads and third threads, wherein the first threads are extended along a warp-wise orientation of the base fabric to form wales and are lapped to form crochets on the base fabric, the second threads are extended along the warp-wise orientation of the base fabric and are repeatedly and cross lapped over two of the wales and the third threads are extended along the warp-wise orientation of the base fabric and are repeatedly and cross lapped over two of the wales, wherein distances of the third threads lapped are greater than distances of the second threads lapped; wherein the base fabric has a rare portion, which is a region of the base fabric having less of the third threads than the other region thereof, wherein the rare portion is arranged at between two of the wales and is extended along the warp-wise orientation of the base fabric; wherein the base fabric further has at least a fourth thread, which is made of a material with a well elasticity, wherein the fourth thread is extended along the warp-wise orientation of the base fabric and is cross lapped over two of the wales to form an elastic portion extended the warp-wise orientation of the base fabric, wherein the elastic portion has a well elasticity for tension and the elastic portion has a side overlapped with a portion of the base fabric on which the third threads are knitted to form an overlapped portion, which makes the elastic portion coupled with the base fabric firmly, and the overlapped portion has a width smaller than or substantially equal to a distance between two of the wales.

DETAILED DESCRIPTION OF THE INVENTION

Figure 1:
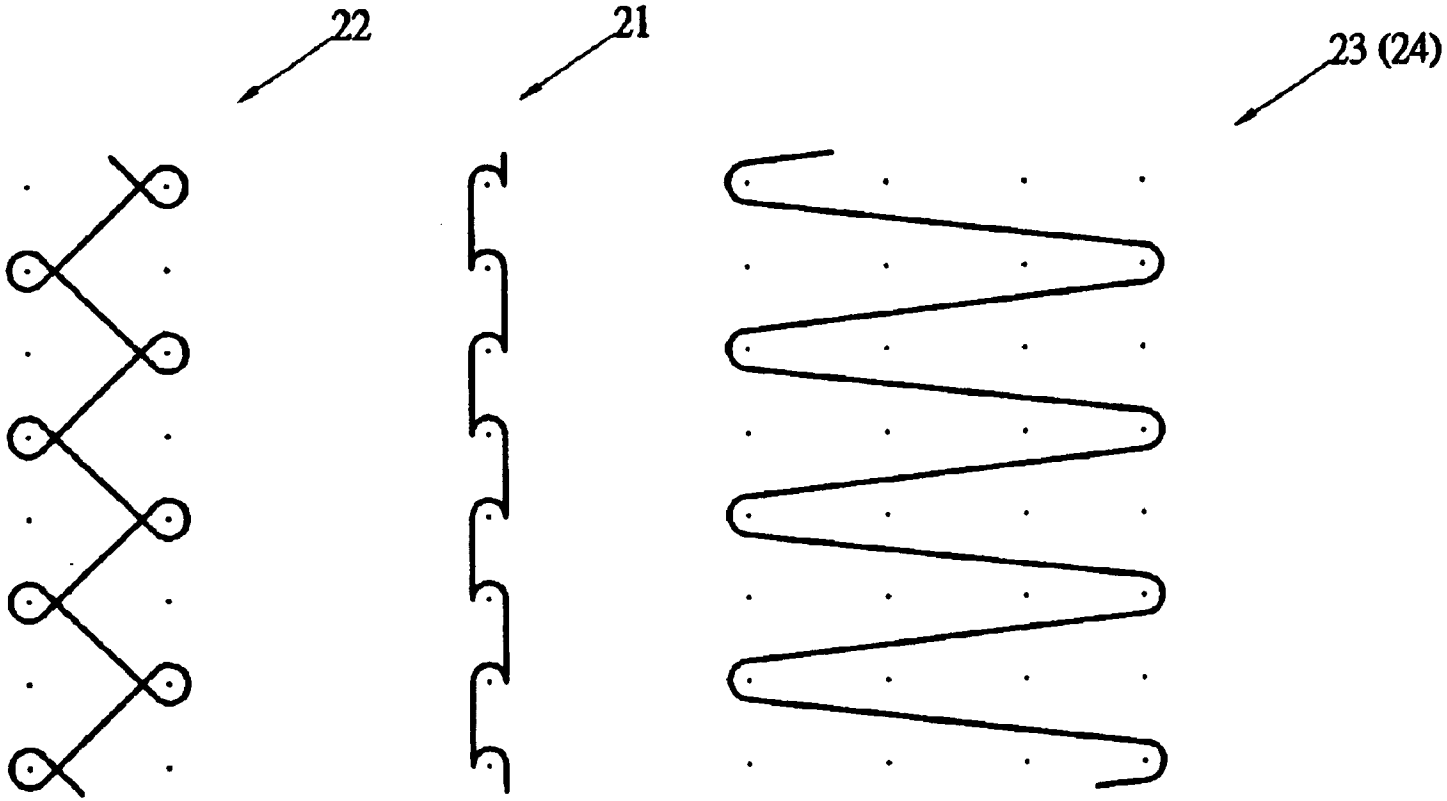
FIG. 1 is a perspective view of a first preferred embodiment of the present invention, showing the knit of individual threads.
Figure 2:
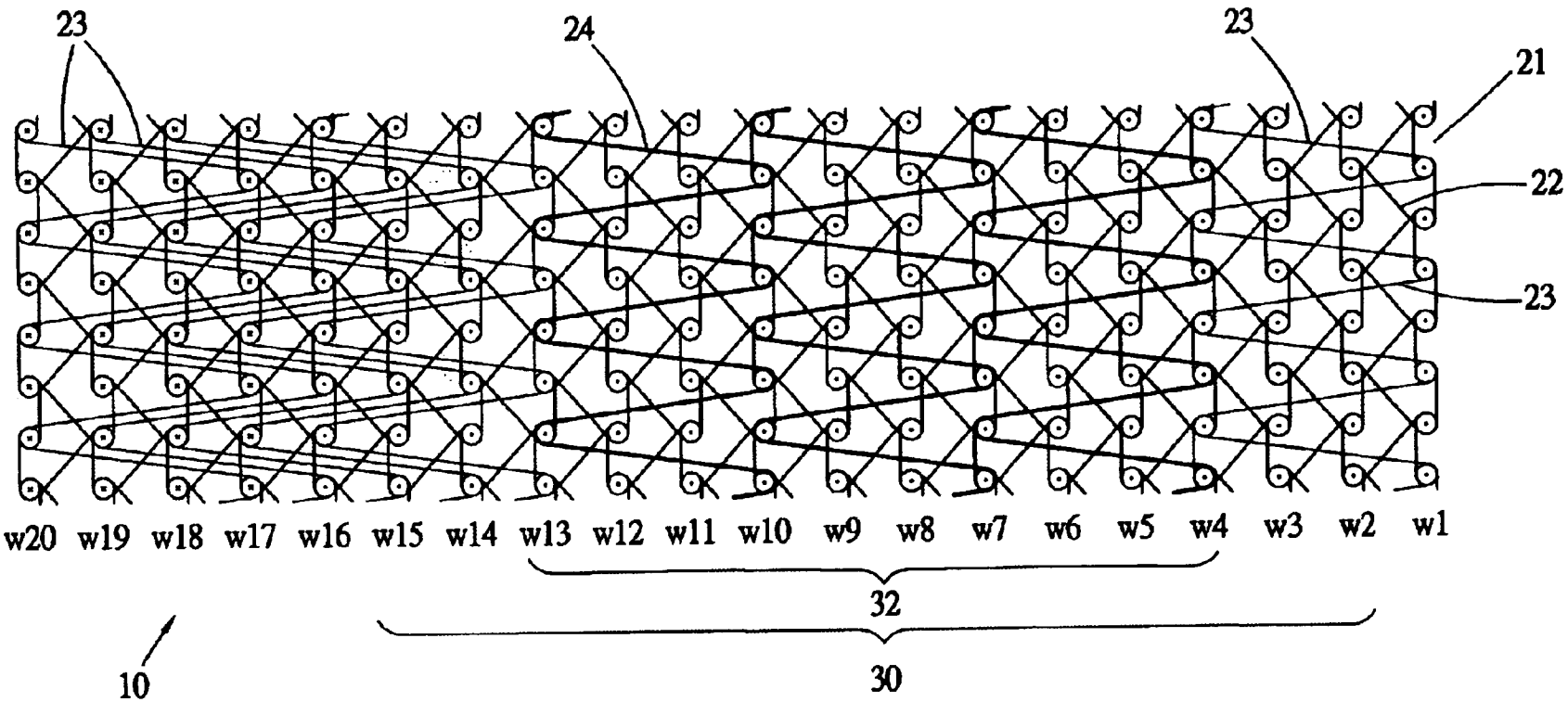
FIG. 2 is a perspective view of the first preferred embodiment of the present invention, showing the knit of the fabric.
Figure 3:
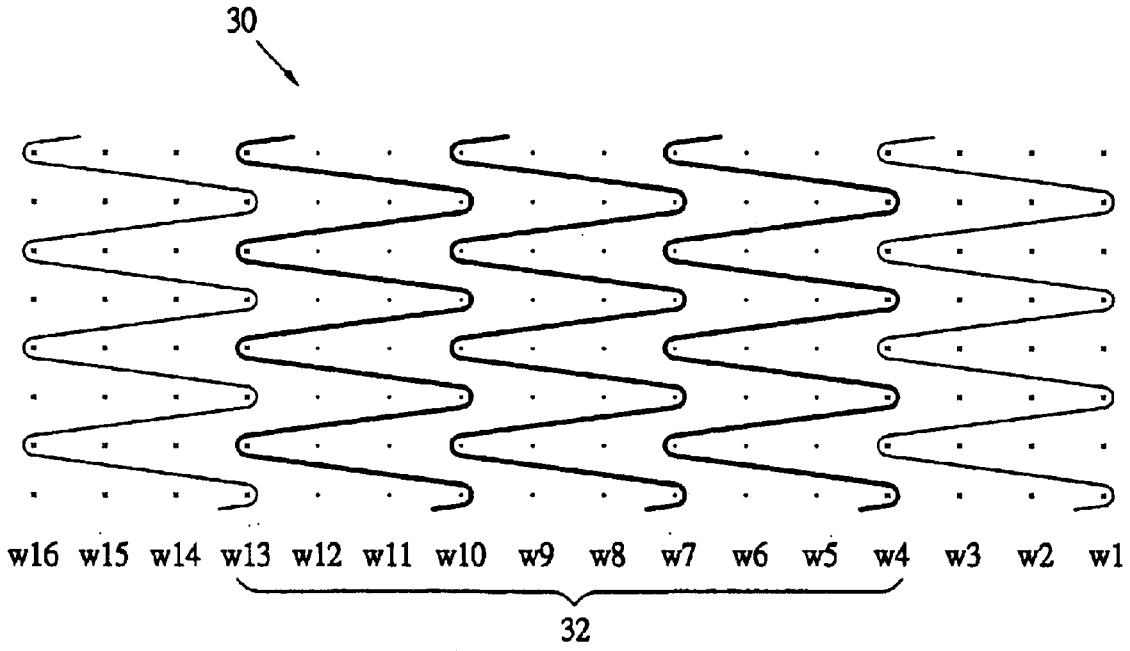
FIG. 3 is a perspective view of the first preferred embodiment of the present invention, showing the fabric and the elastic region.

As shown in FIGS. from FIG. 1 to FIG. 3, a warp knitted fabric of the first preferred embodiment of the present invention is mainly made of chemical fibers having first threads 21, second threads 22 and third threads 23 knitting a base fabric 10. The base fabric 10 further consists of fourth threads 24, which have rubber threads therein such that the fourth threads have a well elasticity.

The first threads 21 form wales of the base fabric 10 along a warp-wise orientation thereof The wales are labeled as w1, w2, w3 . . . etc. in FIG. 2. The first threads 21 are lapped over the second and the third threads 22 and 23 to form crochets. In knitting, there are left crochets, right crochets and middle crochets. In the present preferred embodiment, the first threads are middle crochets.

The second threads 22 are extended along the warp-wise orientation of the base fabric and the neighboring second threads 22 are knitted in one wale.

The third threads 23 cross three needles and lap between two of the wales, which means the third threads 23 are lapped over four wales.

The basic fabric 10 has a rare portion 30 at where between the second wales w2 and the fifteenth wales w15, which is formed by removing eleven third threads 23 including the one extended left (according to the orientation of the FIGS.) from the second wale w2 and lapped over the fifth wale w5, the one extended left from the third wale w3 and lapped over the sixth wale w6, the one extended left from the fourth wale w4 and lapped over the seventh wale w7 . . . and the one extended left from the eleventh wale w11 and lapped over the fifteenth wale w15. The base fabric 10 further has an elastic portion 32 at where between the fourth wale w4 and the thirteenth wale w13, which has three of the fourth threads 24 crossing over every three of the neighboring wales respectively. In the other words, the fourth threads 24 cross over the wales of the fourth wale w4 to the seventh wale w7, the seventh wale w7 to the tenth wale w10 and the tenth wale w10 to the thirteenth wale w13 respectively.

The base fabric 10 has less restrict for tension at the rare portion 30 because there are fewer third threads 23. The second threads are knitted as a tricot pattern, which the second threads 23 are knitted in a pattern of lapping over a needle distance in a top-and-down orientation and a wale in a left-and-right orientation to make it has a well elasticity. The fourth threads 24, which has a superior elasticity, cross the third threads 23 only at the fourth wale w4 and the thirteenth wale w13 that make die elastic portion 32 having a superior elasticity for tension.

While the base fabric 10 is stitched on a cloth or a bag and a transverse force exerted on the base fabric 10, the elastic portion 32 base fabric 10 is deformed first for buffer such that the stitched portion of the base fabric 10 is less to be damaged by the force. The rare portion 31 of the base fabric 10 is soft and well flexible such that it is helpful to buffer the transverse force too and it provides the base fabric 10 a comfortable feeling and a well place for the zip working.

Figure 5:
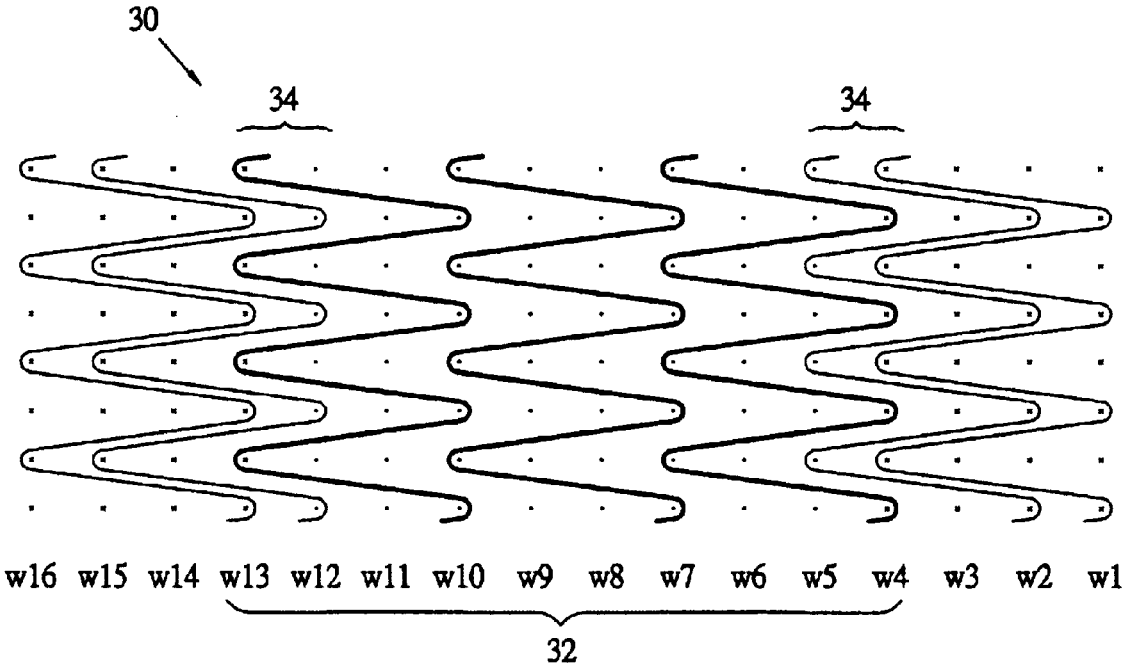
FIG. 5 is a perspective view of the second preferred embodiment of the present invention, showing the fabric and the elastic region.
Figure 4:
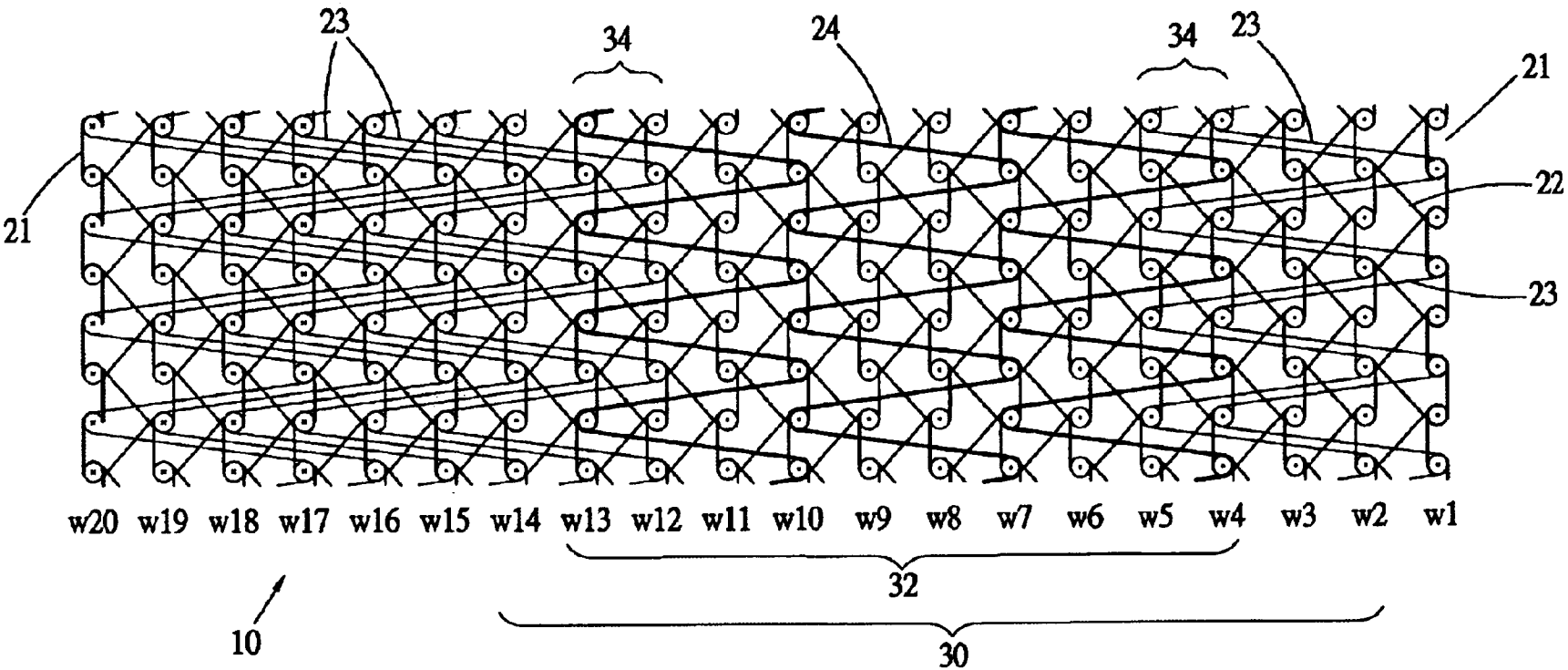
FIG. 4 is a perspective view of a second preferred embodiment of the present invention, showing the knit of the fabric.

In the present preferred embodiment, there are three fourth threads 24 knitted between the fourth wale w4 and thirteenth wale w13 to soft the rare portion 30. In practice, the base fabric might be further provided with overlapped portions 34, which is made by two of the third threads 23 crossing the wales of from the second wale w2 to the fifth wale w5 and the wales from the twelfth wale w12 to the fifteenth wale 15 and the third and fourth threads 23 and 24 crossing the fourth and fifth wales w3 and w4 and the twelfth and thirteenth wale w12 and w13 respectively. The overlapped portions 34 where the third and the fourth threads 23 and 24 are lapped enhance the coupling strength of the elastic portion 32 and the base fabric 10 as shown in FIG. 4 and FIG. 5. An alternate structure of the overlapped portions 34 is that an overlapped portion is provided only on a wale and the other overlapped portion is provided only on two of the neighboring wales, which still are the scope of the present invention.

It has to be mentioned here that the base fabric 10 will decrease the elasticity by increasing the third threads on the wales of the third wale w3 to the sixth wale w6 and the wales of the eleventh wale w11 to the fourteenth wale w14. The reason is that the additional threads restrict the space of tension of the fourth threads 24.

In the preferred embodiment, the fourth threads 24 cross four of neighboring wales between the fourth wale w4 and the thirteenth wale w13. But in practice, there might be elastic threads (not shown) crossing three of the neighboring wales for replacement the fourth threads 24. Such structure reduces the elasticity of the elastic portion 32 but increases the strength of tension resistance. For the same principle, there might be elastic threads (not shown) crossing five of the neighboring wales, which increases the strength of tension resistance and decrease the elasticity.

Figure 6:
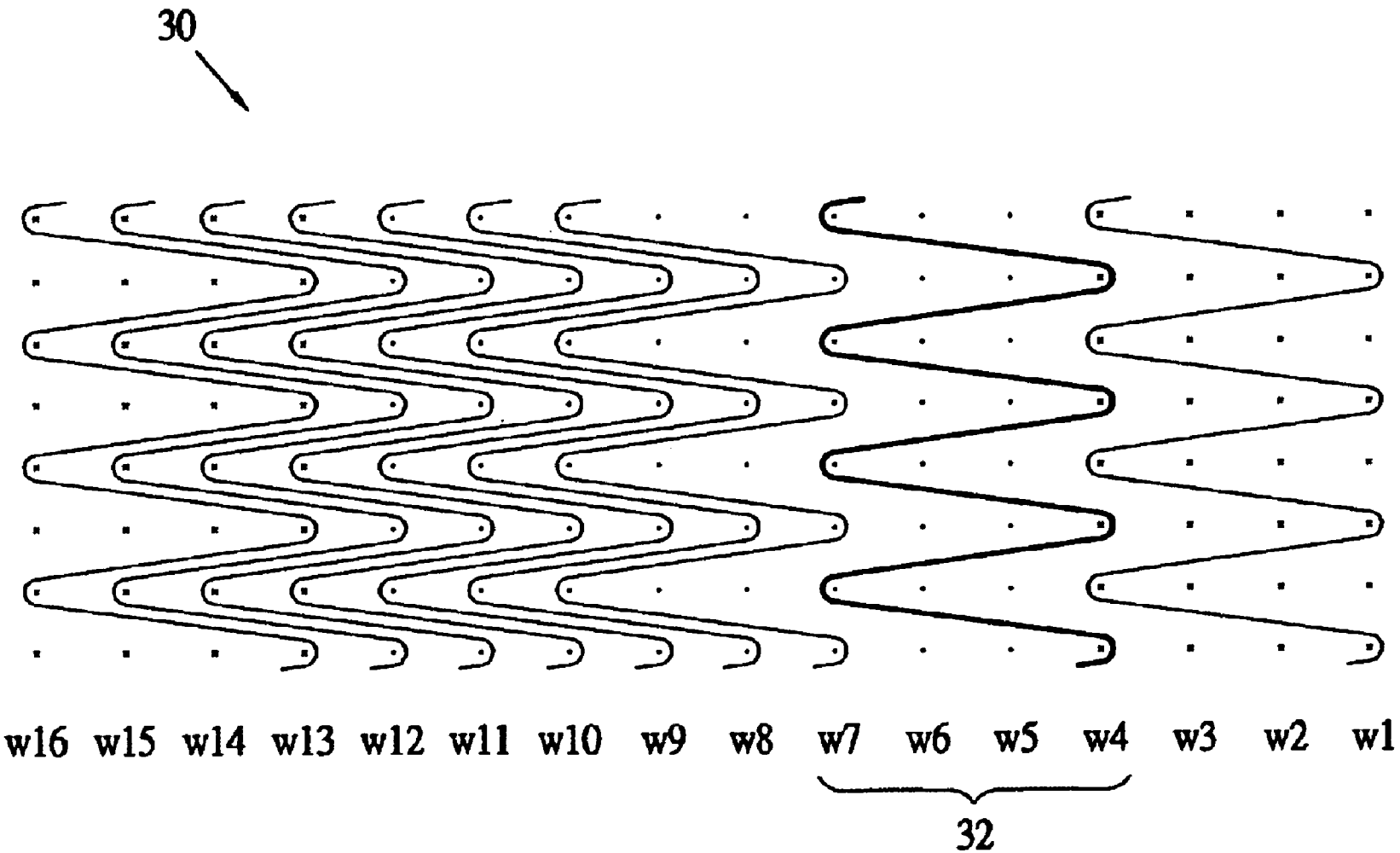
FIG. 6 is a perpective view of the third preferred embodiment of the present invention, showing the fabric and the elastic region.

The elastic portion 32 of the preferred embodiment is arranged at where between the fourth wale w4 and the thirteenth wale w13. In practice, the position of the elastic portion 32 can shift right or left and the number of the fourth threads 24 are alternate according to the real practice. The base fabric 10 can be provided with two parallel elastic portions 32 and the positions of the elastic portions 32 are various according to the real practice. Further, there might be only one clastic thread, as shown in FIG. 6, crossing the fourth wale w4 and seventh wale w7.

Figure 7:
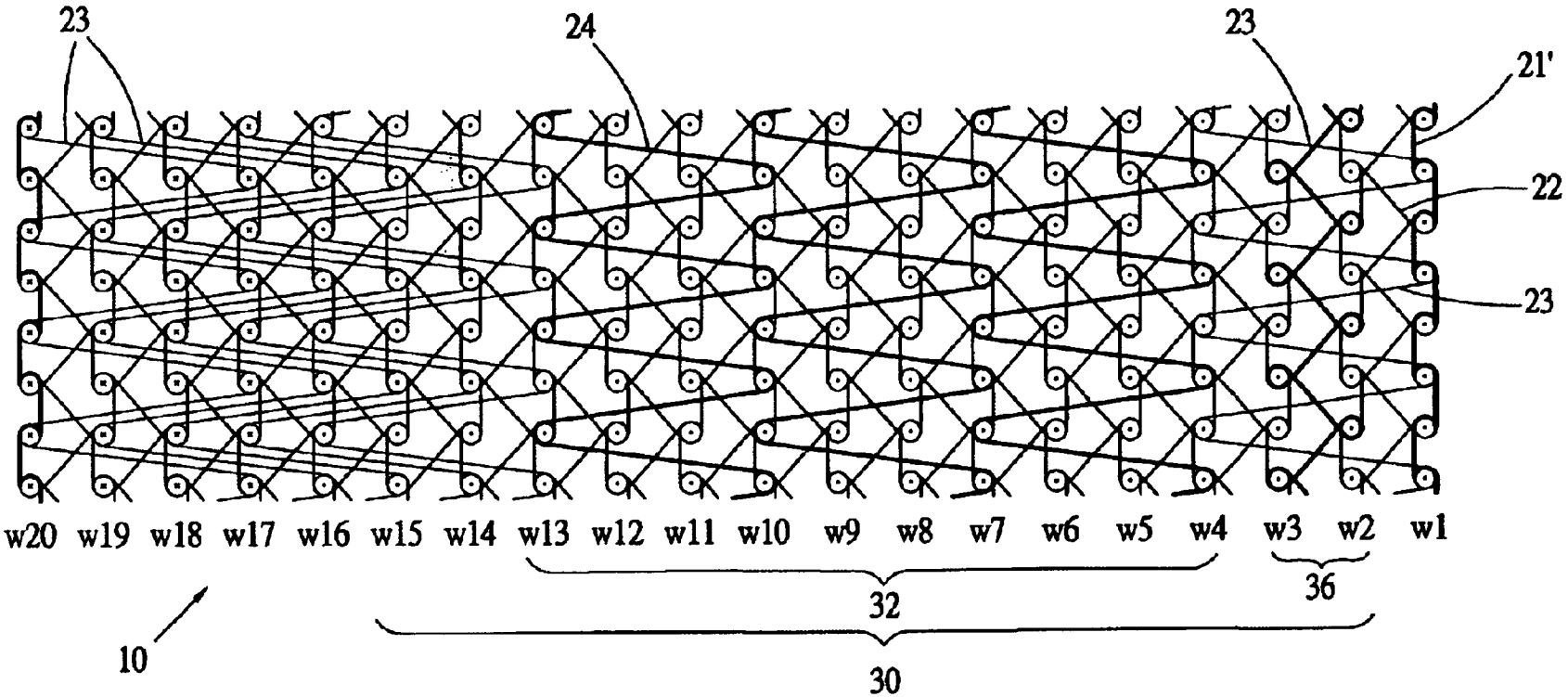
FIG. 7 is a prospective vies of the fourth preferred embodiment the present invention, showing the knit of the fabric.

As showing in FIG. 7, the present invention can further provides two of the first threads 21 respectively at the first wale w1 and the last wale w20 to enthicker said two wales 21', one of the second thread 22 provided crossing the second wale w2 and the third wale w3 to form a thickness-increase area 36 to replenish the thickness between the edge of the elastic portion 32 and the first wale w1, such that the base fabric 10 has a well support at opposite sides thereof and the base fabric 10 will be flatter and stronger.

What is claimed is:

1. A warp knitted fabric, comprising:

a base fabric having first threads, second threads and third threads, wherein the first threads are extended along a warp-wise orientation of the base fabric to form wales and are lapped to form crochets on the base fabric, the second threads are extended along the warp-wise orientation of the base fabric and are repeatedly and cross lapped over two of the wales and the third threads are extended along the warp-wise orientation of the base fabric and are repeatedly and cross lapped over two of the wales, wherein distances of the third threads lapped are greater than distances of the second threads lapped;

wherein the base fabric has a rare portion, which is a region of the base fabric having less of the third threads than the other region thereof wherein the rare portion is arranged at between two of the wales and is extended along the warp-wise orientation of the base fabric;

wherein the base fabric further has at least a fourth thread, which is made of a material with a well elasticity, wherein the fourth thread is extended along the warp-wise orientation of the base fabric and is cross lapped over two of the wales to form an elastic portion extended the warp-wise orientation of the base fabric, wherein the elastic portion has a well elasticity for tension and the elastic portion has a side overlapped with a portion of the base fabric on which the third threads are knitted to form an overlapped portion, which makes the elastic portion coupled with the base fabric firmly, and the overlapped portion has a width smaller than or substantially equal to a distance between two of the wales.

2. The warp knitted fabric as claimed in claim 1, wherein the base fabric has at least two of the rare portions and two of the elastic portions, wherein the rare portions respectively have a portion overlapped with the elastic portions.

3. The warp knitted fabric as claimed in claim 1, wherein the overlapped portion is arranged at one of the wale on which the third threads and the fourth thread are lapped.

4. The warp knitted fabric as claimed in claim 2, wherein a width of the rare portion is greater than a width of the elastic portion.

5. The warp knitted fabric as claimed in claim 1, wherein a distance of the fourth thread lapped is substantially equal to a distance of the third thread lapped.

6. The warp knitted fabric as claimed in claim 1, wherein The warp knitted fabric as claimed in claim 1, wherein a distance of the fourth thread lapped is different from a distance of the third thread lapped.

7. The warp knitted fabric as claimed in claim 1, wherein the base fabric has a wale at an edge thereof made by two first threads lapped.

8. The warp knitted fabric as claimed in claim 1, wherein the base fabric has a thickness-increase area between the edge of the elastic portion and the edge of the base fabric, and the thickness-increase area was formed by two second threads that cross between two wales collectively.

* * * * *